US008505683B1

(12) United States Patent
Dirrig

(10) Patent No.: US 8,505,683 B1
(45) Date of Patent: Aug. 13, 2013

(54) MOVABLE ANCHORING SYSTEM

(76) Inventor: William Dirrig, Kent, OH (US)

( * ) Notice: Subject to any disclaimer, the term of this patent is extended or adjusted under 35 U.S.C. 154(b) by 155 days.

(21) Appl. No.: 12/804,481

(22) Filed: Jul. 22, 2010

Related U.S. Application Data

(60) Provisional application No. 61/227,584, filed on Jul. 22, 2009.

(51) Int. Cl.
*A62B 35/00* (2006.01)
*A63B 27/00* (2006.01)

(52) U.S. Cl.
USPC ..... 182/9

(58) Field of Classification Search
USPC ..... 182/9
See application file for complete search history.

(56) References Cited

U.S. PATENT DOCUMENTS

| | | | | |
|---|---|---|---|---|
| 869,382 | A | 10/1907 | Newton | |
| 1,077,250 | A * | 11/1913 | Allum | 2/236 |
| 1,120,496 | A | 12/1914 | Holsclaw | |
| 1,721,517 | A | 7/1929 | Kamrath | |
| 2,381,114 | A * | 8/1945 | Cox | 182/9 |
| 2,920,714 | A | 1/1960 | Johnson | |
| 2,990,628 | A * | 7/1961 | Black | 36/58.5 |
| 3,804,698 | A * | 4/1974 | Kinloch | 428/176 |
| 3,840,091 | A | 10/1974 | Conlon | |
| 5,141,074 | A | 8/1992 | Sulowski | |
| 5,688,011 | A * | 11/1997 | Gulley | 294/74 |
| 6,108,822 | A * | 8/2000 | Calagui | 2/338 |
| 6,206,138 | B1 * | 3/2001 | Yerger | 182/136 |
| 2006/0272898 | A1 * | 12/2006 | Hovey et al. | 182/135 |

* cited by examiner

*Primary Examiner* — Alvin Chin Shue
(74) *Attorney, Agent, or Firm* — David M Lowry

(57) ABSTRACT

A movable anchoring safety device attached to a hunter or other person for use in ascending and descending a tree or vertically inclined circular structure member. The device consists of a multi layered strap with a substantial portion of the strap having an internally embedded biased spring material such as spring steel configured to have a circular inward bias. In use, this portion of the multilayered strap clings to the circumference of the circular member. The device is easily repositioned either upward or downward while climbing or descending. In fixed position, the strap cinches to the climbing surface and operates to anchor the climber in position and stop any fall or unwanted downward movement. The apparatus is particularly useful in enabling a hunter to safely climb a tree without interference from the device while using and positioning an elevated tree stand.

13 Claims, 7 Drawing Sheets

MOVABLE ANCHORING SYSTEM

This Application claims the benefit of a Provisional Patent filed on Jul. 22, 2009, and known as Application No. 61/227,584.

BACKGROUND OF THE INVENTION

The device disclosed by this invention relates generally to the field of safety equipment for use in securing persons while traversing vertically inclined surfaces at elevated heights.

More particularly, this invention discloses an apparatus to be used by climbers in ascending and descending trees or, for that matter, any vertically inclined surface which is generally circular in character.

In situations where an individual is engaged in activity at on an elevated surface, it is common to wear some form of fall restraint belt or harness to tether the individual to the elevated surface. The purpose is quite simple. Should the individual fall or slip, the user will only move a short distance and become suspended upon the vertical member thereby avoiding a fall to the ground and the potentially catastrophic injuries which may result from such an event. Examples of where a safety harness system would be warranted include a hunter in an elevated tree stand or a power line worker tethered to a telephone pole.

There have been various safety devices defined for use by lineman and telephone pole climbers. For example, Pat. No. 869382 (Newton), 1120496 (Holsclaw), 1721517 (Jacobs), 2920714 (Johnson), 3407898 (Johnson), and 3840091 (Conlon). Generally, these inventions define a passive belt type system which relies upon the use of teeth or other biting elements to engage the pole at the time of a fall. In response to these limitations other embodiments have been defined. Sulowski (5,141,074) discloses a strap assembly reliant upon an elastic tensile member under tension to engage a pole with the tension member being disengaged during the climbing process.

Harnesses and safety straps as existing generally provide a degree of increased safety but only when used properly. Most users commonly affix themselves to an anchor once achieving a desired height. However, it would be beneficial to have a system which not only protects the user at a selected height but also during the climb and descent. At any stage of the climb or descent, human error such as a slip or equipment malfunction may result in significant injury.

Safety harnesses are manufactured in many forms and configurations and include straps made from rope, webbing, or cloth. Nearly any material may be used as long as there is sufficient material strength to provide the requisite strength in a fall situation. Also, it is important to select a material capable of withstanding the elements and, perhaps most importantly, the continuous abrasion and friction sustained by the material due to the constant relocation, placement, and manipulation on rough vertical structures such as for example a wooden telephone poles or heavily barked trees. On the other hand, materials must also be suitable for smoother surfaces shown on a concrete telephone pole or smooth barked tree such as a young cherry tree.

Natural elements such as ice, snow, rain and even darkness increase the risk of danger for climbers. Also, human emotion such as excitement or fear may play a part in a serious injury while climbing. The use of a movable anchoring system would help to alleviate those types of injuries.

Current safety systems are not readily adaptable for use during the actual climbing or descending of the climber. The current art is more defined as protecting an individual once a desired height is achieved. Modern ropes and restraints are problematic when traversing up and down because of irregularities and hindrances in the surface, gravity, roughness of the surface and size of the vertical member. Current art mechanisms also have some very significant limitations when used on a particularly smooth surface.

Hence, it would be most beneficial to have a safety restraint system easily usable while climbing or at rest in fixed position.

One very significant use of restraint systems is by hunters or nature enthusiasts in the placement of portable tree stands in trees during hunting or nature viewing endeavors. In fact, portable tree stands are in wide spread use and becoming increasingly popular. They are carried through the woods and used at any previously undetermined location. One simply walks through the woods and climbs to a suitable height without any previous thought as to safety measures or, for that matter, the suitability of the tree for climbing. Unfortunately, placement of a portable stand is an arduous task. Most tree stands are manufactured so the hunter is able to use the geometric configuration of the stand to enable climbing and placement. A standard tree stand generally has an upper and lower climbing member. Each member has a cable or other means to attach to the tree encircling the tree and both members have multiple toothed or biting member "prongs" or feet like structures which are placed against the tree. The climbing members are set in a cantilevered position. The hunter flexes and moves the upper member (while ascending) in relation to the tree using a scissor like jerking motion. Placement of the prongs or feet against the tree allows the member to be "jerked" to a higher or lower location. Once in place the lower member (while ascending) is then raised. The process is repeated until a desired height is achieved. The movement is not very great for any one "jerking" motion and the act is quite physical. To protect the hunter against a fall during this climbing phase, manufacturers normally equip the tree stand with a restraint strap capable of attachment to the hunter and the tree. Attachment from the tree is normally through a carabineer, d-ring, buckle, etc. onto a vest or belt worn by the climber. Some only use a simple rope system and the rope system is nothing more than a rope with a slip knot which encircles the tree. The rope is loosened by the hunter every time any movement up or down is desired. The hunter then relocates the rope to the new desired location by hand. This simple system may provide some protection but is a time consuming and difficult task which, in itself, poses safety concerns. For example, in situations where heavy bark or other obstructions are encountered, relocation of the slip knot and rope is a very requiring the use of both hands.

Some of the above limitations have been recognized and there have been attempts to define a more appropriate product. For example Yerger (6,206,138) has described an improved system less likely to interfere with the climbing motion and, therefore, more likely to be used in the tree climbing process. However, Yerger still does not overcome the significant obstacles of the prior art relating to safety devices for hunters utilizing tree stands. This is evident from the fact current models of tree stands are normally provided only with the simple slip knot system described in this Background and Summary of the Invention.

BRIEF SUMMARY OF THE INVENTION

It is a principal object of the disclosed invention to address all of the objects of the current restraint systems but to more importantly provide a solution for the limitations inherent in the current art.

It is also one of the major objects of the device to create a product and system which not only acts as a safety system but is easy to use and operate. Particularly in that it is easily repositioned during the climbing phase. Simplicity of use eliminates the reluctance of use in the part of a hunter or other user.

It is a further desire to define a product capable of restraint during the climbing and ascending of a tree or other vertical member which, due to its configuration, is easily slid or repositioned upon the climbing surface. Upon repositioning, it cinches against the vertical member on its own without any action on the part of the user due to the inwardly biased nature of a portion of the mechanism. Once positioned the restraint remains in place firmly snug against the member without the need of constant adjustment or introduction of a foreign object into the climbing surface for attachment means.

The present invention recognizes and addresses the foregoing limitations and needs of being anchored both while ascending and descending and once at a fixed location or height.

The device is especially adaptive for use by hunters and other individuals in assisting to climb a tree by hand.

The movable anchoring system defined by the present invention consists generally of a single strap of stiff flexible webbing made of polyester, nylon, cotton, or other suitable material with sufficient rigidity and strength to accomplish the purposes defined herein. The strap is folded in back upon itself and stitched, glued or otherwise permanently affixed to itself along the majority of its length but leaving a male loop defined at a first end and a female loop defined at the opposite second end. As stated, the strapping is sewn, stitched, glued or joined together by other suitable methods but prior to such joinder; a rigid biased material is "sandwiched" between the folded material in a pocket formed between the folded material in such fashion to hold it in place in position closely contiguous to the female loop. The biased material in its resting position forms generally a semi circle. When straightened and released, its physical nature allows it to snap back into a circular resting shape as its natural state. If the biased material is flexed outwardly with any force at all, it exhibits an inward bias to its resting position. The anchoring strap has any multitude of attachments loops on the exterior of the strap at a position relative to the female loop.

In use, the portion of the device containing the biased element is placed around the circumference of a tree, pole, or other substantially circular member. To obtain placement, the rigid biased material is extended outwardly to enable it to circle the tree or pole. Upon release, the strap snaps into its resting position. If the circumference of the tree is any size larger than the circumference defined by the strap in its resting shape, the strap through the inner tension and bias "hugs" the tree and adheres in its placement. If the tree or pole is smaller than the resting circumference defined by the strap, the male loop is placed through the appropriate adjustment loop corresponding to the desired size. It then also is held in place.

The use of the movable anchoring system really defines the beauty of the invention. As discussed above, the prior art relies upon a looping concept using a flexible rope or webbing which encircles a tree. When climbing, the rope must be moved by hand to a higher location. It must be held there for if it is released, it will simply fall back down due to gravity. If there are obstructions or particularly rough bark then the user must take time to grasp the rope and jerk, move, or shake the rope to get over or around the obstacle. These deficiencies are exacerbated in the descending process. For example, the rope has a tendency to fall further than desired as there is no way to control the position of the rope with gravity pulling the rope to such point dictated only by the length of the rope itself. Hassles such as described are part of the reason hunters neglect or refuse to use a simple restraint system and, in some instances, sustain serious injury.

On the other hand, the instant device eliminates and addresses all of these short comings. In use, after attachment to the tree or other member, the male loop is fed and placed through the female loop and attached securely by means of a carabineer, d-ring or other fastener to the hunter. Upon climbing the person simply forces the biased material outward and moves the strap either up of down the tree. The rigid nature of the strap alleviates problems traversing heavy bark, obstructive materials on the surface of the tree, and other obstacles. Once a desired point is realized, the hunter simply releases the strap and it "snaps' into firm contact with the tree. The ease and simplicity make it possible to concentrate on the task at hand (climbing) while providing a static system that is in integral relationship to the tree. Should the hunter slip or fall, the strap tightens immediately upon the tree and the hunter falls only a very short distance. There is no "slack' in the strap as you would see in the conventional loose rope system. Additionally, a tear away system provides even more protection as it effectively reduces the distance of any fall. By illustration, the carabineer, d-ring or other attachment means may be placed through any of the tear away loops found adjacent to the male loop. If the hunter falls, the distance of the fall is shortened by the use of the placement of the securing means which effectively shortens the strap. In a preferred embodiment, the tear away loops have been designed to "tear away" such that the hunter will not be "jerked" at the termination point of the fall as established by the length of the strap. In effect, the tear away loops indeed tear away one at a time until the securing means reaches a terminating point set by the male loop. This allows the hunter to fall in a somewhat controlled manner thereby reducing the ambit of injuries which may result from the jarring and jerking stop of an uncontrolled fall of greater distance.

Due to the nature of the claimed invention, the device is attached to a climber by simple tethering means and easily repositioned upon the vertical surface when climbing or descending. The inwardly biased nature of a portion of the strap cinches and grips the vertical surface during climbing and also provides pulling support for climbing. At a fixed position the apparatus remains securely affixed to the surface once again due to the inherent inwardly biased pressure associated with the manufacture of the strap mechanism. Once at a desired height, the apparatus then further acts as a safety tethering system anchoring the individual in place.

According to another aspect of the defined invention, there is a light flexible device that folds into a convenient circular configuration for transport in and out of the woods. Velcro fastening means wrap around the device to hold the strap in its convenient configuration for transport and storage.

The foregoing and further objects and inventions shall become evident from the detailed descriptions and claims as recited below.

DETAILED DESCRIPTION OF THE DRAWINGS

Figure 1:
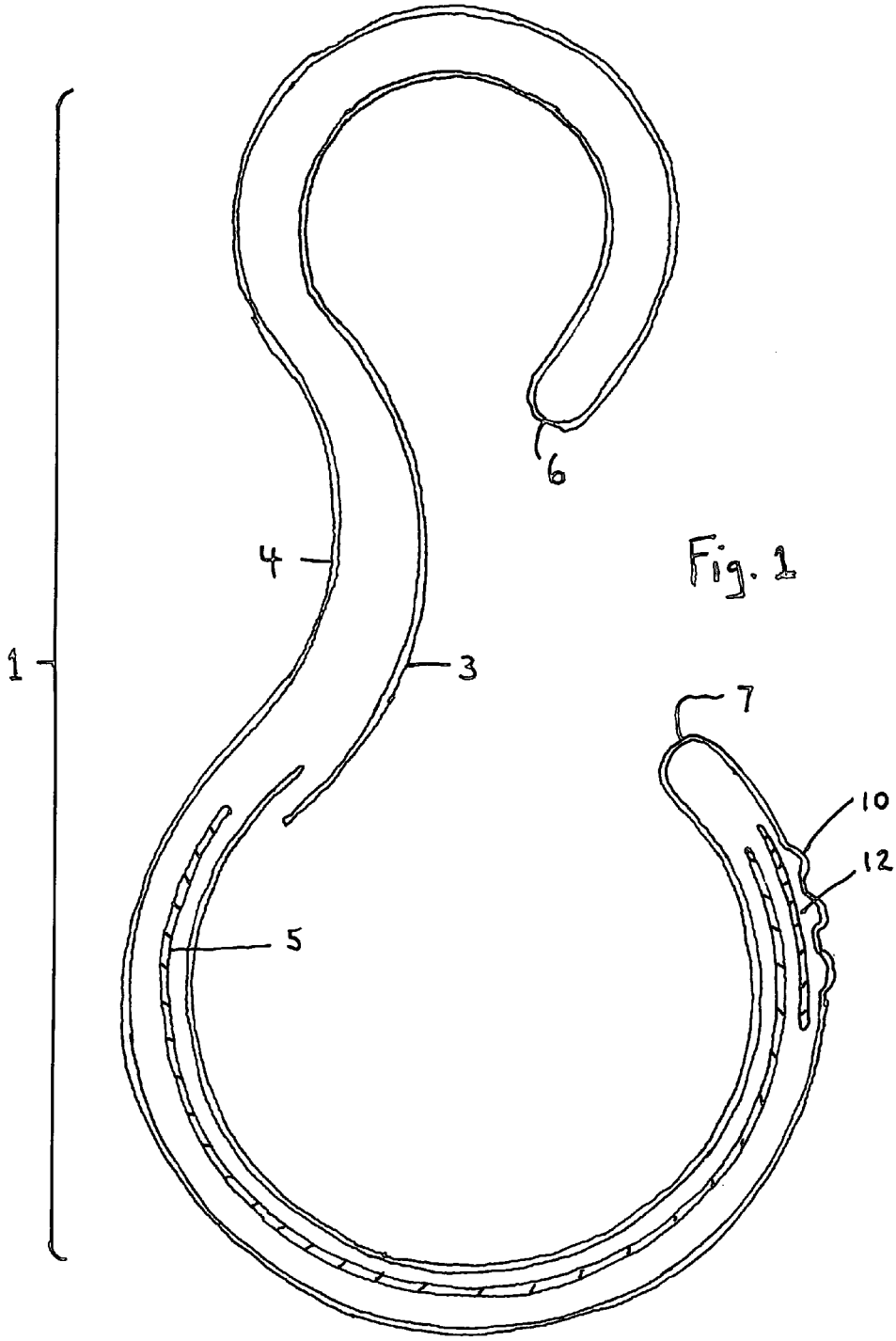
FIG. 1 is an exploded simplistic view of the device from above looking down upon the device sitting on edge.

FIG. 1 is a simplistic depiction of the movable anchoring system in exploded view. The anchoring system according to the present invention is shown and generally delineated as numeral 1. Generally, FIG. 1 is offered to show that with the exception of middle cover strap 12, anchoring system 1 is comprised of a single strand of anchor strap 2 composed of flexible webbing material manufactured of materials such as nylon, polyester, or cloth. Materials such as leather or other woven components may alternately be used. Selection of the proper material(s) would be a function of the physical attributes necessary for the proper functioning of anchoring system 1. The material must be flexible yet somewhat stiff in design. Also, the material must be able to withstand the elements and the constant abrasive abuse incurred in sliding over bark, nails, rough surfaces and obstructions encountered during climbing. In a preferred embodiment, anchoring system 1 is approximately 78 inches in overall length and composed of nylon webbing 1½ inches wide. This length is certainly not cast in stone but has been found to be capable of adaptability to an assortment of tree and pole circumferences.

As shown in FIG. 1, anchor strap 2 is turned back upon itself and forms a first end 6. Second end 7 is formed by anchor strap 2 at the end opposite first end 6. In the state folded back upon itself, anchor strap 2 generally is defined as having interior strap 3 and exterior strap 4. FIG. 1 then shows biased spring element 5 sandwiched between interior strap 3 and exterior strap 4. Note the location of biased spring element 5 in proximity to second end 7. In a preferred example, biased spring element 5 is approximately 34 inches in length.

The physical characteristics of biased spring element 5 are very important and define this invention. Biased spring element 5 must be of a material that is rigid, strong and capable of being bent or molded in a generally semi circular geometric configuration. Once bent or molded, biased spring element 5 must retain the semi circular confirmation when in resting position. Perhaps even more importantly, biased spring element 5 must be resilient and completely flexible. Once flexed, it must be of character such that when released it will immediately spring back to the same resting shape and geometry time after time. In preferred embodiment, biased spring element is composed of spring steel rolled to the desired circular configuration resulting in a diameter of approximately 9 inches. This diameter has been shown in preferred embodiment to work nicely and allow anchor strap 2 to fit around and snug tightly to a wide range of tree sizes and configurations. It is also of note that a preferred embodiment uses a biased spring element 5 composed of two (2) separate strands of spring steel. However, other embodiments use a singular piece of spring steel or other material such as molded plastic. Provided the requisite strength, rigidity, flexibility and geometric memory are present, any formula of single or multiple pieces used to form biased spring element 5 would be acceptable. FIG. 1 shows the presence of a small section of middle strap 12 sandwiched between interior strap 3 and exterior strap 4 in relation to adjustment loops 10. This middle strap 12 material is needed due to the exposure of biased spring element 5 when exterior strap 4 is manipulated to create adjustment loops 10. It is sewn, glued or otherwise attached over top of biased spring element 5 in position beneath exterior strap 4.

Finally, this Figure shows how anchor strap 2 is a single piece of material and the relative termination points of original anchor strap 2 prior to joining the original ends at a location adjacent to the embedded biased spring element 5.

Figure 2:
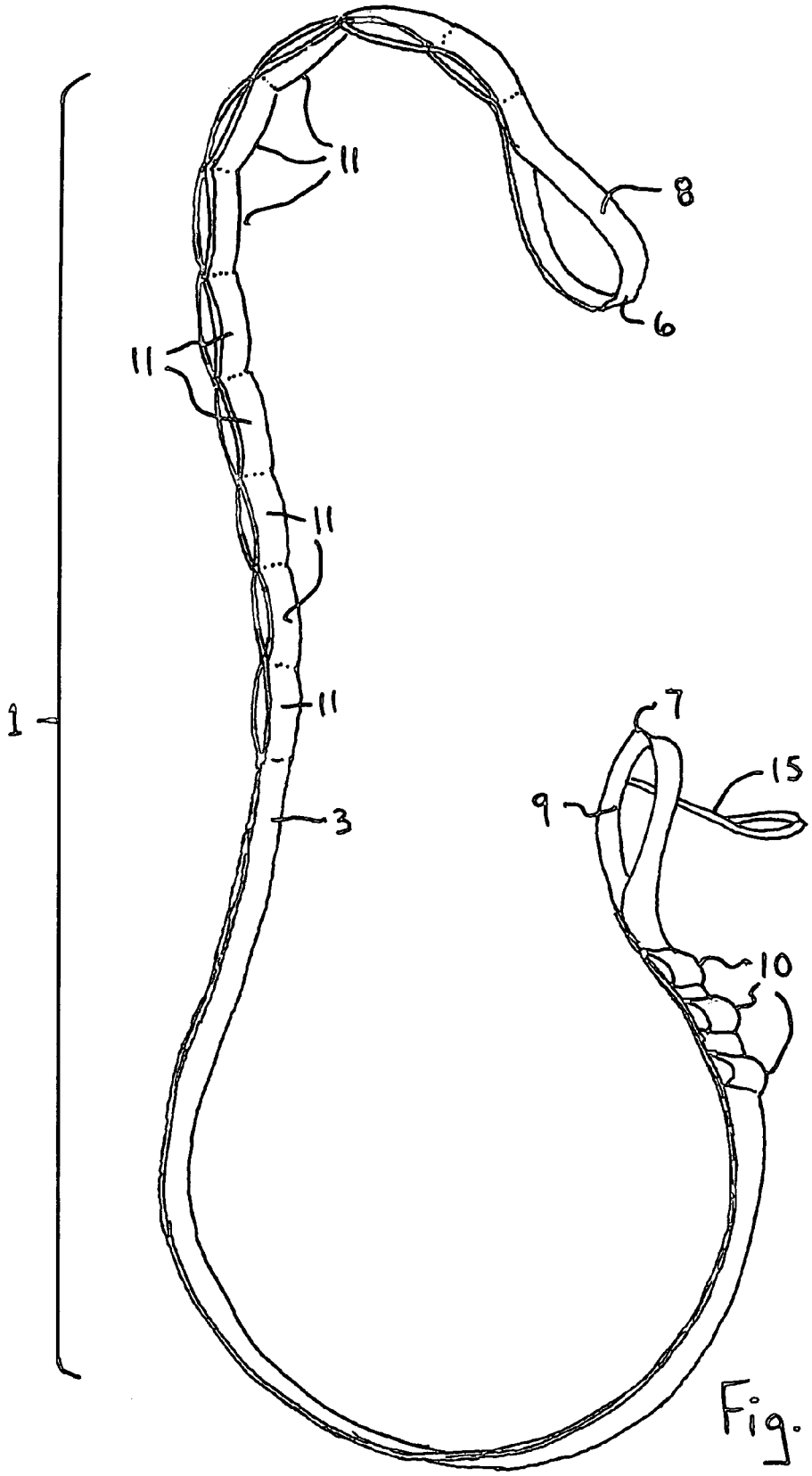
FIG. 2 is an isometric view of the present invention showing most aspects and the general configuration and nature of the device.

FIG. 2 is a drawing which depicts all of the elements of anchoring system 1 with the exception of biased spring element 5 which is hidden from view due to its enclosure by interior strap 3, exterior strap 4 and the brief portion of middle strap 12. Readily visible is male loop 8 formed at first end 6 by stitching interior strap 3 to exterior strap 4. Male loop 8 must be large enough to receive a carabineer, d-ring or other attachment means with the intention that such attachment means will in some manner be attached to a hunter or other climber after anchoring system 1 is placed around a tree or pole. Also visible at second end 7 is female loop 9 which is also formed by stitching interior strap 3 to exterior strap 4. The requisite size of female loop 9 is defined by the need to receive and pass male loop 8. This Figure also shows a plurality of adjustment loops 10 located adjacent to the attachment area establishing female loop 9. These adjustment loops 10 are used to adjust anchoring system 1 to fit small diameter trees by allowing insertion of male loop 8 through any of the adjustment loops 10. Therefore, the size requirement of adjustment loops 10 is defined as that necessary to successfully pass male loop 8 through same without hindrance.

FIG. 2 also shows a novel feature known as release strap 15. This is used primarily when descending a tree or other vertical member. With its location attached upon female loop 9, a climber simply pulls on release strap 15 and anchor strap 2 flexes outwardly. The release of release strap 15 permits the spring biased element 5 to again collapse around the tree without the need to even touch anchor strap 2 other than through release strap 15. This is quite a divergence from the prior art that would require at least one and perhaps even two hands to wrestle with a safety restraint to move it lower in an orderly fashion. Release strap 15 is manufactured from a Velcro like product and therefore serves another unique purpose. After use, anchor strap 2 may be rolled upon itself in a tight circle. This allows it to be in a neat and easy format for transport and storage. Release strap 15 is used to circle around anchor strap 2 and attach to itself by hook and loop action. This means a compact and easily transportable device ready for subsequent use.

Figure 3:
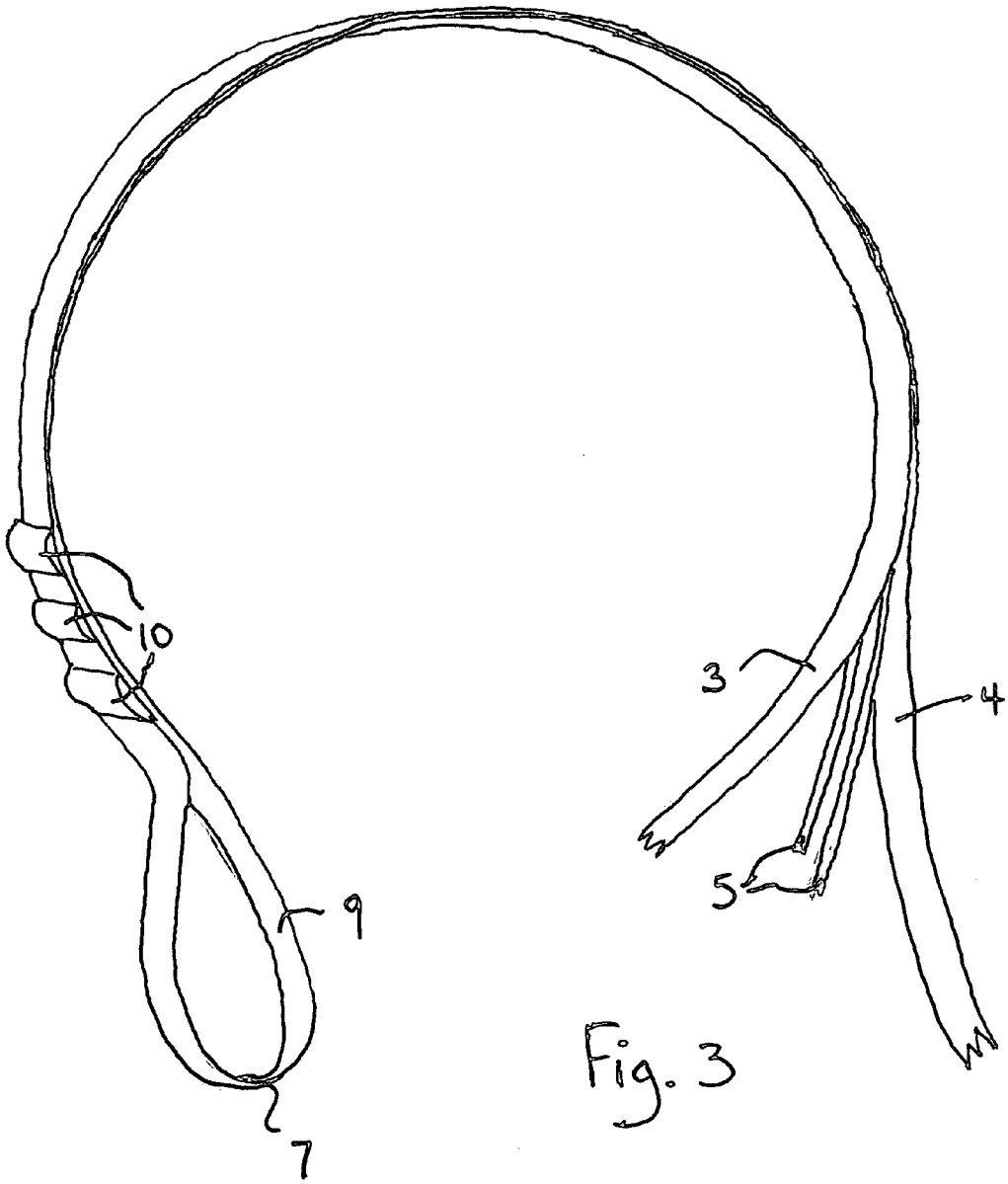
FIG. 3 is the invention with a portion cut away to disclose the webbing and biased spring steel element placement between the interior and exterior webbing surfaces.

FIG. 3 is a depiction of interior strap 3 and exterior strap 4 split apart to show biased spring element 5 embedded and sandwiched between them.

Figure 4:
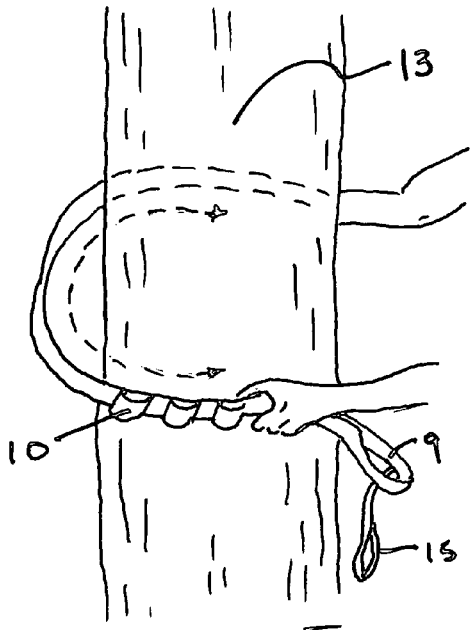
FIG. 4 depicts the first stage of using the anchoring system by first attaching the device through reaching around a member, such as a tree in this instance, using both hands.

FIG. 4 shows the anchoring system 1 in use. A climber places anchor strap 2 around a tree as the beginning step of using anchor system 1. Here, an individual opens or spreads first end 6 and second end 7 apart by flexing anchor strap 2 and embedded biased spring element 5 outwardly. Once around the tree the first end 6 and second end 7 are released and the biased nature of biased spring element 5 snaps anchor strap 2 inward in integral and snug contact with the tree circumference. Note release strap 15 in position for use as defined above.

Figure 5:
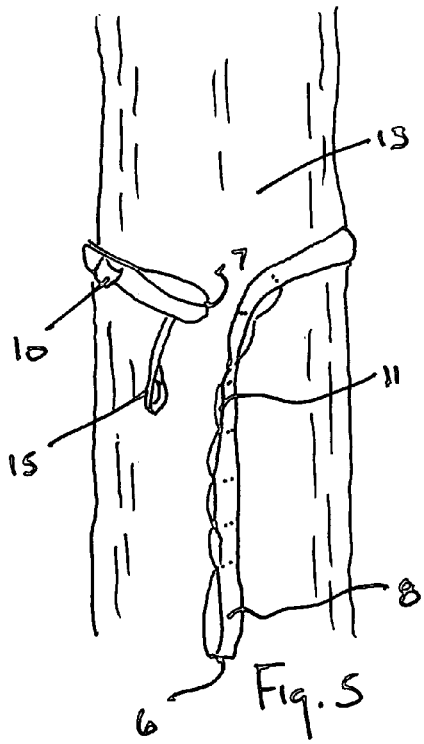
FIG. 5 demonstrates the placement of the invention on a tree and shows the innate ability of the strap to affix itself securely upon the tree without being threaded due to the biased spring nature of a portion of the anchor strap.

FIG. 5 show anchor strap 2 hanging on tree 13. It will remain in place and not slip down or move due to the inward bias created by biased spring element 5.

Figure 6:
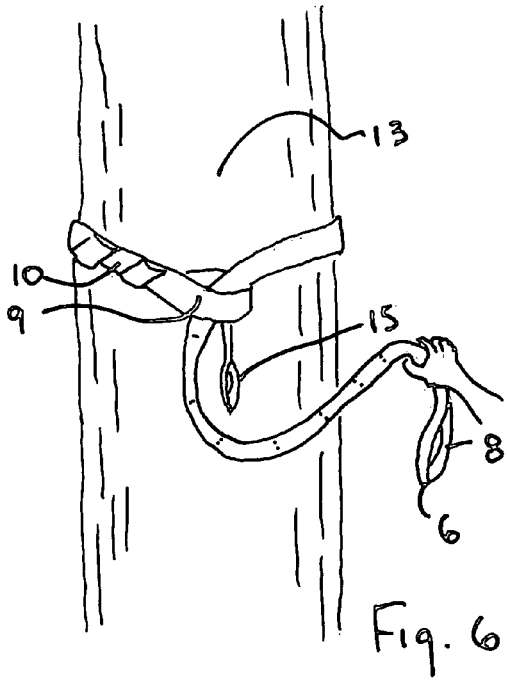
FIG. 6 shows the device properly threaded and ready for attachment to a fall restraint safety belt or harness prior to ascending the tree.

FIG. 6 shows how anchoring system 1 appears after insertion of male loop 8 through female loop 9 in place on tree 13.

Figure 7:
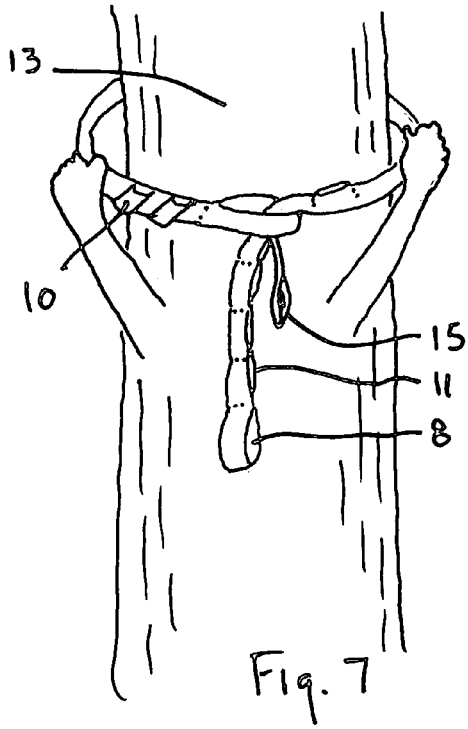
FIG. 7 illustrates how the device is relocated up or down the tree by simply opening the circumference of the biased portion of the strap. It is able to be relocated with little to no contact with the tree surface which makes relocation a significantly easier task than products defined in the prior art.

FIG. 7 shows anchor strap 2 around tree 13. Male loop 8 has been inserted through female loop 9. Here, anchor strap 2 is being flexed outward to a size greater than the circumference of tree 13. Upon release, it will snap back against tree 13 due to the bias of biased spring element 5. Also shown is release strap 15. It is apparent from this drawing that pulling on release strap 15 will indeed cause anchor strap 2 to flex outward thereby enabling hands free movement of anchor strap 2 to a lower location.

Figure 8:
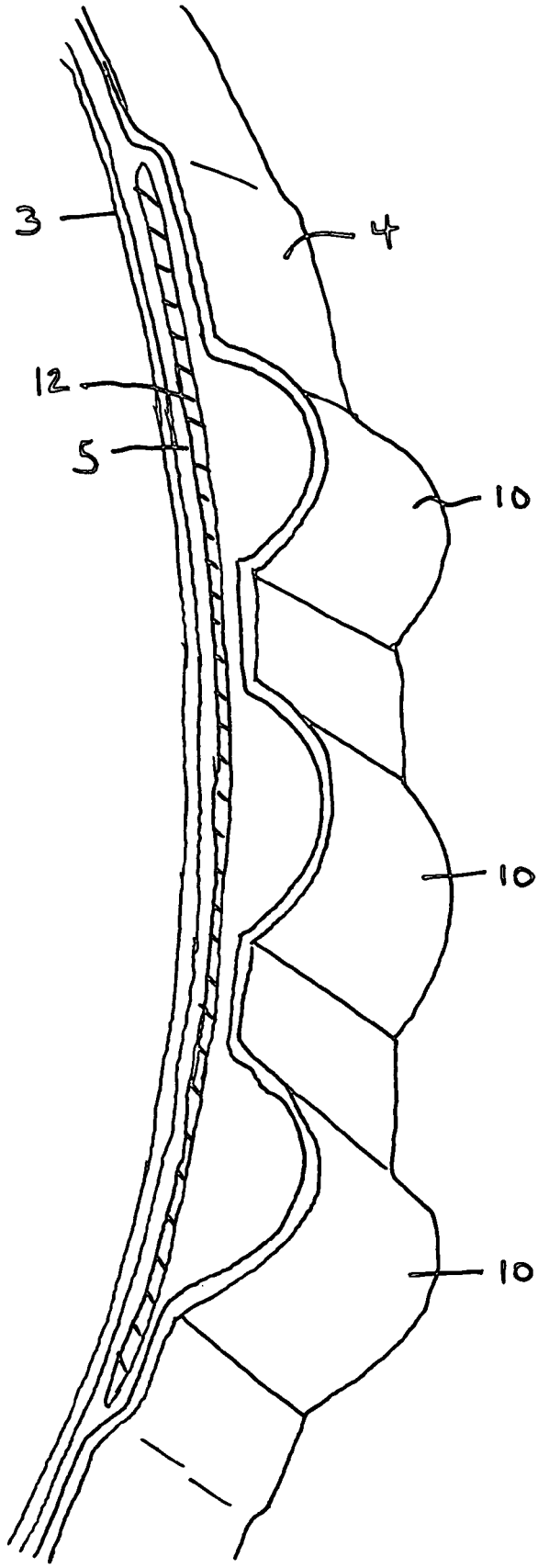
FIG. 8 is a cross sectional view of the anchoring strap in the location of the plurality of attachment loops and shows the configuration of the biased spring element enclosure and the use of a middle strap to cover the spring element in this part of the anchor strap.

FIG. 8 shows a portion of the anchor strap 2 at the location of the adjustment loops 10. Here, middle strap 12 is visible along with biased spring element 5 sandwiched between interior strap 3 and exterior strap 4. Also, this shows how the adjustment loops 10 are actually portions of exterior strap 4 made to such size as to permit insertion of male loop 8 through them to reduce the diameter of the of the semi circular geometry of biased spring element 5 for use on smaller diameter trees and/or branches.

Figure 9:
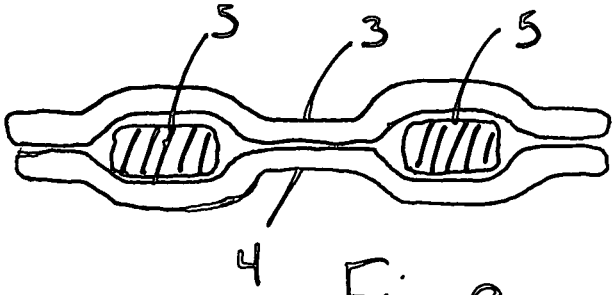
FIG. 9 is a sectional view of a portion of the biased portion of the strap showing the webbing and, in this depiction, the use of two separate strands of spring steel for the spring biased element.

FIG. 9 is a cross sectional view of a portion of anchor strap 2 with biased spring element 5 embedded therein. This Figure shows one of the preferred embodiments namely, two separate strands of spring steel.

Figure 10:
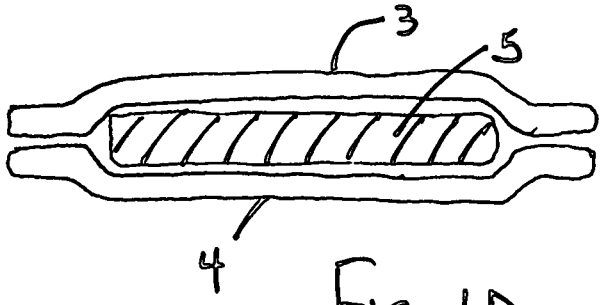
FIG. 10 shows a sectional view as in FIG. 9 but here another embodiment is depicted, namely the use of a single piece of spring steel or other suitable material as the spring biased element.

FIG. 10 depicts the same sectional view as FIG. 9 but with a singular piece of spring steel or other flexible rigid material embedded therein.

Figure 11:
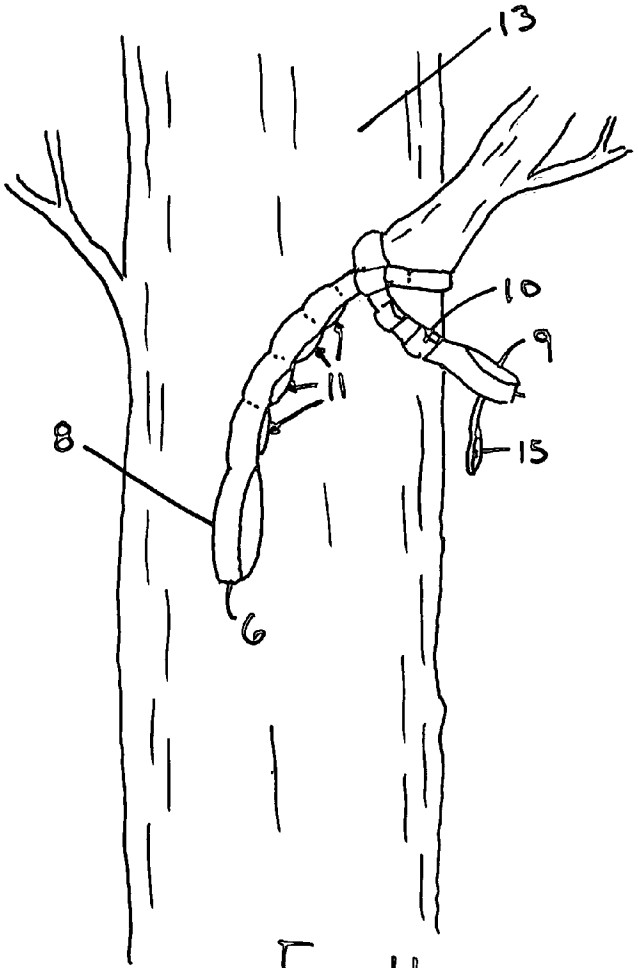
FIG. 11 is a view of the anchoring strap system located on a smaller diameter branch and attachment through the use of one of the adjustment loops located on the body of the anchor strap.

FIG. 11 is a depiction of the anchoring system 1 in use on a small branch. Here, male loop 8 has been passed through adjustment loops 10 to compress the biased spring element 5 into a position to attach snugly to the small diameter branch.

Figure 12:
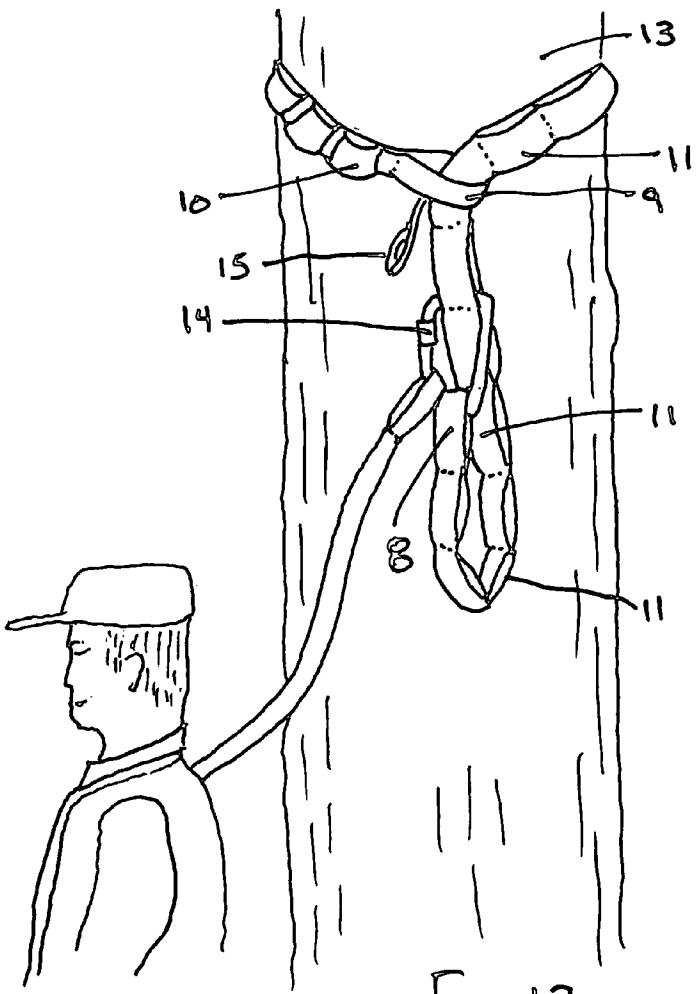
FIG. 12 depicts the device in use and shows an individual attached to the anchor strap by attachment means. Note the use of certain tear away loops provided in the anchor strap. This reduces the distance of any fall from the location of attachment of the anchor strap to a vertical member which, in this case, is a tree.

FIG. 12 shows tear away loops 11 as used in practice. Attachment means 14 is inserted through any of the tear away loops 11. In the event of a fall or slip, the distance of the fall or slip is shortened by the decrease in length of the individual from the actual location where anchoring system 1 is affixed to tree 13. In practice, tear away loops 11 are designed to shred or "tear away" in the event of a major fall. Depending on the possible weight of the user and the circumstances of the fall it is possible only one of the tear away loops 11 will be torn. The means of attaching tear away loops 11 through use of predetermined amounts of glue, sewing thread or other means dictates the amount or actual stress needed to burst through the various tear away loops. In practice, as the tear away loops 11 shred in succession, there is a natural tendency to slowly stop the rate of descend thereby reducing injury. These features shorten the fall and reduce the jerk or abrupt jarring realized when anchoring system 1 catches and stops the fall. This abrupt stopping and jarring is often quite significant and does result in significant injuries to the climber. This device reduces the likelihood of such injuries. Even if all tear away loops 11 are destroyed, the integrity of anchoring system 1 remains intact as any fall would still be controlled and stopped as attachment means 14 ultimately confronts first end 6.

It is apparent that many and numerous modifications including substitution of materials comprising anchor strap 2 and biased spring element 5 are conceivable and practical. However, it is a specific intention to grant this Application the broadest interpretation of the Claims appended to this Specification and of the general inventive concepts espoused in the various parts comprising this Application.

I claim:

1. A movable anchoring system for use by individual users as a safety device to stop or lessen a fall when climbing a tree or other vertical member or from a fixed stationary elevated height on a tree or vertically inclined member comprising:

a single anchor strap of flexible and durable construction which when folded back upon itself and securely joined together so as to form the strap with an interior strap and an exterior strap having first and second ends, said anchor strap being of sufficient length to traverse the circumference of a tree or other vertical member and further capable of attachment to the user by attachment means from the first end after the first end is placed through the second end, and a semi circular rigid flexible biased spring element embedded in a pocket between the interior and exterior straps in close proximity to the second end which when straightened or flattened is capable of wrapping around the tree or other member and when released reverts immediately to its original shape thereby cinching tightly against the circumference of the tree or other member to hold said anchor strap at a desired elevated height or enable the anchor strap to be easily and readily relocated upon the surface of the tree or other member by causing the biased spring element to be expanded and then released as desired during the ascent or decline in a climbing maneuver, wherein a release strap is attached to the second end for relocating the anchoring system during descent as pulling the release strap forces open the biased spring element thereby enabling hands free movement of the anchoring system down the tree or the other vertical member, wherein the release strap is manufactured of material consistent with hook and loop technology and used to wrap around and secure the anchoring system when it is rolled up for transport and storage.

2. The movable anchoring system of claim 1, wherein the first end and second end are further defined by a male loop and female loop respectively, formed by stitching, gluing, or otherwise joining together the interior strap and exterior strap at points inward along the length of the anchor strap from the first and second ends.

3. The movable anchoring system of claim 1, wherein the anchor strap is of sufficient strength and rigidity and composed of webbing material manufactured from leather, nylon, polyester, or cloth.

4. The movable anchoring system of claim 1, wherein the biased spring element is manufactured of spring steel.

5. The movable anchoring system of claim 1, wherein the biased spring element is composed of plastic.

6. The movable anchoring system of claim 2, wherein a portion of the exterior strap adjacent to the male loop is configured to contain a plurality of tear away loops which enable a user to shorten the length of the anchor strap to reduce the distance the user could fall or slip before the anchoring system would slow and catch the user and stop the descent.

7. The movable anchoring system of claim 6, wherein the tear away loops are joined to the interior strap by stitching, gluing, or other means intended to permit the tear away loops to tear away one at a time to slow the fall or slip of a user incrementally thereby reducing jarring or jerking.

8. The movable anchoring system of claim 2, wherein a portion of the exterior strap adjacent to the female loop is configured to contain a plurality of adjustment loops intended to accept the male loop for the purpose of defining a smaller circular configuration of the biased spring element thereby allowing the anchoring system to be used on smaller diameter branches, trees, or vertical members.

9. The movable anchoring system of claim 1, wherein the biased spring element is preferably 34 inches in length.

10. The movable anchoring system of claim 1 wherein the length of the anchor strap after it has been folded over upon itself is 78 inches.

11. The movable anchoring system of claim 1, wherein the anchor strap has a width of 1½ inches.

12. The movable anchoring system of claim 1, wherein the biased spring element is comprised of a plurality of strands of spring metal.

13. The movable anchoring system of claim 1, wherein the biased spring element consists of a single piece of material.

* * * * *